US008364052B2

(12) United States Patent
Iwaya et al.

(10) Patent No.: US 8,364,052 B2
(45) Date of Patent: Jan. 29, 2013

(54) FIXING DEVICE AND IMAGE FORMING APPARATUS INCORPORATING SAME

(75) Inventors: Naoki Iwaya, Chofu (JP); Akira Shinshi, Machida (JP); Masaaki Yoshikawa, Tokyo (JP); Kenji Ishii, Kawasaki (JP); Kenichi Hasegawa, Atsugi (JP); Hiroshi Yoshinaga, Ichikawa (JP); Tetsuo Tokuda, Kawasaki (JP); Yoshiki Yamaguchi, Sagamihara (JP); Yutaka Ikebuchi, Chigasaki (JP); Ippei Fujimoto, Ebina (JP); Shuntaroh Tamaki, Kawasaki (JP); Takahiro Imada, Yokohama (JP); Takamasa Hase, Kawasaki (JP); Toshihiko Shimokawa, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 332 days.

(21) Appl. No.: 12/881,547

(22) Filed: Sep. 14, 2010

(65) Prior Publication Data

US 2011/0064443 A1 Mar. 17, 2011

(30) Foreign Application Priority Data

Sep. 15, 2009 (JP) ..... 2009-213102

(51) Int. Cl.
*G03G 15/20* (2006.01)

(52) U.S. Cl. ..... 399/69; 399/328; 399/329

(58) Field of Classification Search ..... 399/38, 399/67–70, 122, 320, 328–330; 219/216, 219/619

See application file for complete search history.

(56) References Cited

U.S. PATENT DOCUMENTS

| | | | |
|---|---|---|---|
| 6,131,009 | A | 10/2000 | Hasegawa |
| 6,496,666 | B2 | 12/2002 | Hayashi et al. |
| 6,591,081 | B2 | 7/2003 | Hasegawa |
| 6,628,916 | B2 | 9/2003 | Yasui et al. |

(Continued)

FOREIGN PATENT DOCUMENTS

| | | |
|---|---|---|
| CN | 101000484 A | 7/2007 |
| JP | 2007-334205 | 12/2007 |

(Continued)

OTHER PUBLICATIONS

U.S. Appl. No. 12/841,593, filed Jul. 22, 2010, Yoshikawa, et al.

(Continued)

*Primary Examiner* — Hoan Tran
(74) *Attorney, Agent, or Firm* — Oblon, Spivak, McClelland, Maier & Neustadt, L.L.P.

(57) ABSTRACT

A fixing device includes a hollow, stationary metal roller, a flexible fuser belt, a rotatable pressure member, a fuser pad, a reinforcing member, and a heating assembly. The metal roller has an outer circumference thereof subjected to heating. The flexible fuser belt is looped for rotation around the metal roller to transfer heat radially outward from the heated metal roller. The fuser pad is held stationary inside the loop of the fuser belt to press against the pressure member through the fuser belt to form a fixing nip. The reinforcing member is disposed stationary within the roller interior. The heating assembly is disposed stationary within the roller interior to heat the metal roller from inside, and includes a first heater and a second heater. The first and second heaters are arranged in juxtaposition with each other along the inner circumference of the metal roller.

7 Claims, 5 Drawing Sheets

U.S. PATENT DOCUMENTS 6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.
6,813,464 B2 11/2004 Amita et al.
6,881,927 B2 4/2005 Yoshinaga et al.
6,882,820 B2 4/2005 Shinshi et al.
6,892,044 B2 5/2005 Yasui et al.
6,937,827 B2 8/2005 Katoh et al.
7,022,944 B2 4/2006 Yoshinaga et al.
7,070,182 B2 7/2006 Hasegawa
7,127,204 B2 10/2006 Satoh et al.
7,151,907 B2 12/2006 Yoshinaga
7,239,838 B2 7/2007 Sato et al.
7,242,897 B2 7/2007 Satoh et al.
7,313,353 B2 12/2007 Satoh et al.
7,330,682 B2 2/2008 Shinshi
7,379,698 B2 5/2008 Yoshinaga
7,454,151 B2 11/2008 Satoh et al.
7,466,949 B2 12/2008 Satoh et al.
7,509,085 B2 3/2009 Yoshinaga et al.
7,515,850 B2 4/2009 Hasegawa
7,546,049 B2 6/2009 Ehara et al.
7,548,718 B2 * 6/2009 Kubota et al. ..... 399/329
7,570,910 B2 8/2009 Ishii
7,593,680 B2 9/2009 Shinshi
7,630,652 B2 12/2009 Hasegawa
7,742,714 B2 6/2010 Shinshi et al.
7,783,240 B2 8/2010 Ito et al.
7,860,419 B2 * 12/2010 Tateishi et al. ..... 399/70
8,010,028 B2 * 8/2011 Shinshi ..... 399/329
2006/0029411 A1 2/2006 Ishii et al.
2006/0257183 A1 11/2006 Ehara et al.
2007/0003334 A1 1/2007 Shinshi et al.
2007/0014600 A1 1/2007 Ishii et al.
2007/0059071 A1 3/2007 Shinshi et al.
2007/0166062 A1 7/2007 Shimokawa
2007/0292175 A1 12/2007 Shinshi
2008/0063443 A1 3/2008 Yoshinaga et al.
2008/0112739 A1 5/2008 Shinshi
2008/0175633 A1 7/2008 Shinshi
2008/0219730 A1 9/2008 Shinshi
2008/0226326 A1 9/2008 Seo et al.
2008/0232873 A1 9/2008 Ueno et al.
2008/0253788 A1 10/2008 Shinshi
2008/0253789 A1 10/2008 Yoshinaga et al.
2008/0298862 A1 12/2008 Shinshi
2008/0317532 A1 12/2008 Ehara et al.
2009/0003867 A1 1/2009 Fujimoto
2009/0067902 A1 3/2009 Yoshinaga et al.
2009/0123201 A1 5/2009 Ehara et al.
2009/0123202 A1 5/2009 Yoshinaga et al.
2009/0148204 A1 6/2009 Yoshinaga et al.
2009/0148205 A1 6/2009 Seo et al.
2009/0169232 A1 7/2009 Kunii et al.
2009/0245865 A1 10/2009 Shinshi et al.
2009/0245897 A1 10/2009 Seo et al.
2009/0297197 A1 12/2009 Hase
2009/0311016 A1 12/2009 Shinshi
2010/0061753 A1 3/2010 Hase
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2010/0303521 A1 12/2010 Ogawa et al.

FOREIGN PATENT DOCUMENTS

JP 2008-158482 7/2008

OTHER PUBLICATIONS

U.S. Appl. No. 12/823,770, filed Jun. 25, 2010, Hasegawa.
U.S. Appl. No. 12/879,875, filed Sep. 10, 2010, Fujimoto, et al.
U.S. Appl. No. 12/881,547, filed Sep. 14, 2010, Iwaya, et al.
Chinese Office Action issued May 29, 2012, in Patent Application No. 201010284428.5.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2009-213102, filed on Sep. 15, 2009, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical, looped belts or rollers, one being heated for fusing toner ("fuser member") and the other being pressed against the heated one ("pressure member"), which together form a heated area of contact called a fixing nip through which a recording medium is passed to fix a toner image under heat and pressure.

One conventional type of fuser assembly employed in the fixing device is an endless belt looped for rotation around a hollow, generally cylindrical, stationary metal roller or pipe, typically formed by bending a thin sheet of conductive metal into a rolled configuration, which has its outer circumference entirely or partially facing the inner surface of the looped fuser belt. The metal roller is provided with a heater inside the hollow interior to conduct heat to its circumference, from which heat is radially transferred to the length of the fuser belt rotating around the metal roller.

Using a thin-walled metal roller allows for heating the fuser belt swiftly and uniformly, resulting in shorter periods of warm-up time and first-print time required to complete an initial print job upon startup, and high immunity against printing failures caused by insufficient heating of the fixing nip in high-speed application.

In specific configuration, the metal roller may have a fuser pad disposed outward from the roller interior and inward from the loop of the fuser belt for facing the inner surface of the fuser belt at the fixing nip. The fuser pad is used in combination with a flat, elongated reinforcing member accommodated within the metal roller to support the fuser pad under nip pressure. The reinforcing member extends across the generally cylindrical cross-section of the metal roller to partition the roller interior into narrow compartments, in one of which the roller heater is disposed facing the inner circumference of the roller.

One problem associated with such high-speed fuser assembly is that the fuser belt has its non-operating area (i.e., an area or extent that neither overlaps nor contacts a recording sheet passing through the fixing nip) excessively heated, and occasionally even thermally damaged, where the fixing device processes a number of recording sheets smaller than the width of the fuser belt in succession. Excessive heating of the fuser belt is attributed primarily to the use of a thin-walled metal roller in the fixing device. Having a low heat capacity and hence a fast thermal response, the metal roller immediately conducts heat for transfer to the fuser belt, which then accumulates heat along its sides where it does not contact the recording sheets being processed.

The problem is particularly pronounced where the fuser assembly is provided with a reinforcing member disposed inside the metal roller. This is because the heater, accommodated within a narrow compartment created by the reinforcing member partitioning the roller interior, is positioned in close proximity with the inner surface of the metal roller. Such positioning causes the heater to intensively heat the closest surface of the metal roller, resulting in a greater risk of excessively heating the non-operating area of the fuser belt than that with the roller interior unpartitioned.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a hollow, stationary metal roller, a flexible fuser belt, a rotatable pressure member, a fuser pad, a reinforcing member, and a heating assembly. The metal roller extends in a longitudinal direction, and has an inner circumference thereof subjected to heating. The flexible fuser belt is looped for rotation around the metal roller to transfer heat radially outward from the metal roller. The rotatable pressure member extends opposite the metal roller in the longitudinal direction, with the flexible fuser belt interposed between the rotatable pressure member and the metal roller. The fuser pad is held stationary inside the loop of the fuser belt to press against the pressure member through the fuser belt to form a fixing nip through which a recording medium is passed to fix a toner image under heat and pressure. The reinforcing member is disposed stationary within the roller interior to thrust against the fuser pad for reinforcement. The heating assembly is disposed stationary within the roller interior to heat the metal roller from inside, and includes a first heater and a second heater. The first heater has a heating element thereof positioned facing a longitudinal center of the metal roller. The second heater has a heating element thereof positioned facing two longitudinal ends of the metal roller. The first and second heaters are arranged in juxtaposition with each other along the inner circumference of the metal roller.

Other exemplary aspects of the present invention are put forward in view of the above-described circumstances, and provide a novel image forming apparatus.

In one exemplary embodiment, the image forming apparatus includes an electrophotographic imaging unit and the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
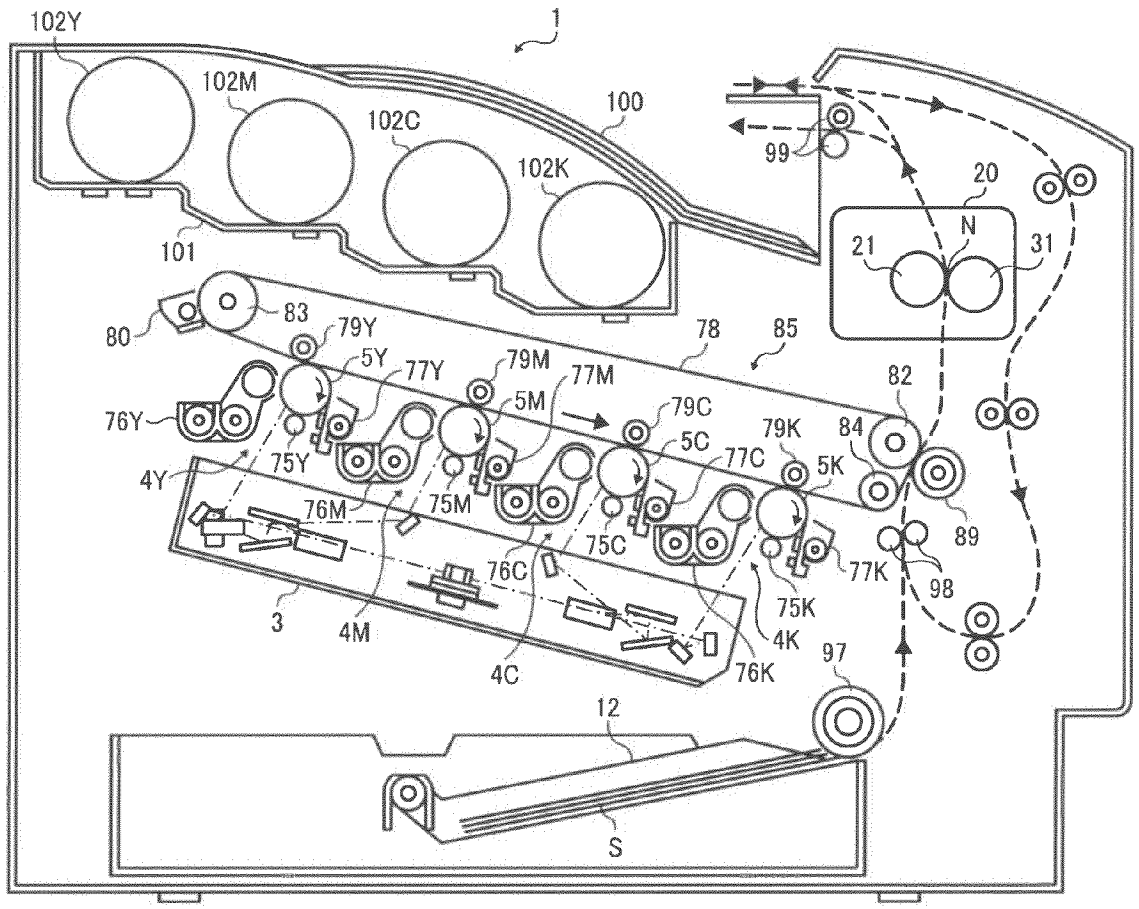
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of ejection rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image into visible form using toner. The toner image thus obtained is forwarded to the primary transfer nip between the intermediate transfer belt 85 and the primary transfer roller 79.

At the primary transfer nip, the primary transfer roller 79 applies a bias voltage of a polarity opposite that of toner to the intermediate transfer belt 85. This electrostatically transfers the toner image from the photoconductive surface to an outer surface of the belt 85, with a certain small amount of residual toner particles left on the photoconductive surface. Such transfer process occurs sequentially at the four transfer nips along the belt travel path, so that toner images of different colors are superimposed one atop another to form a multicolor image on the surface of the intermediate transfer belt 85.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 85 forwards the multicolor image to the secondary transfer nip between the transfer backup roller 82 and the secondary transfer roller 89.

In the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 85 to the secondary transfer nip. At the secondary transfer nip, the multicolor image is transferred from the belt 85 to the recording sheet S, with a certain small amount of residual toner particles left on the belt surface.

After secondary transfer, the intermediate transfer belt 85 enters the belt cleaner 80, which removes and collects residual toner from the intermediate transfer belt 85. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the output rollers 99 to the output tray 100 for stacking outside the apparatus body, which completes one operational cycle of the image forming apparatus 1.

Figure 2:
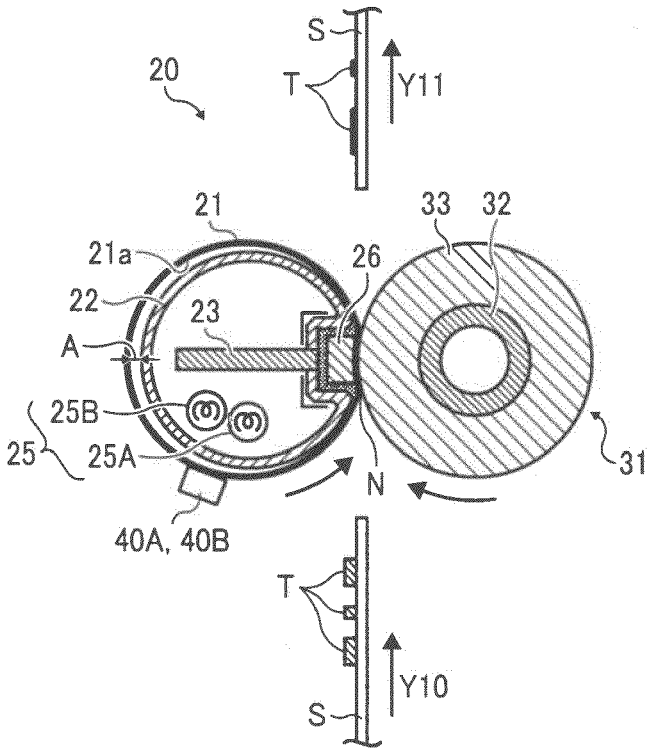
FIG. 2 is an end-on, axial cutaway view schematically illustrating one example of the fixing device incorporated in the image forming apparatus of FIG. 1.
Figure 3:
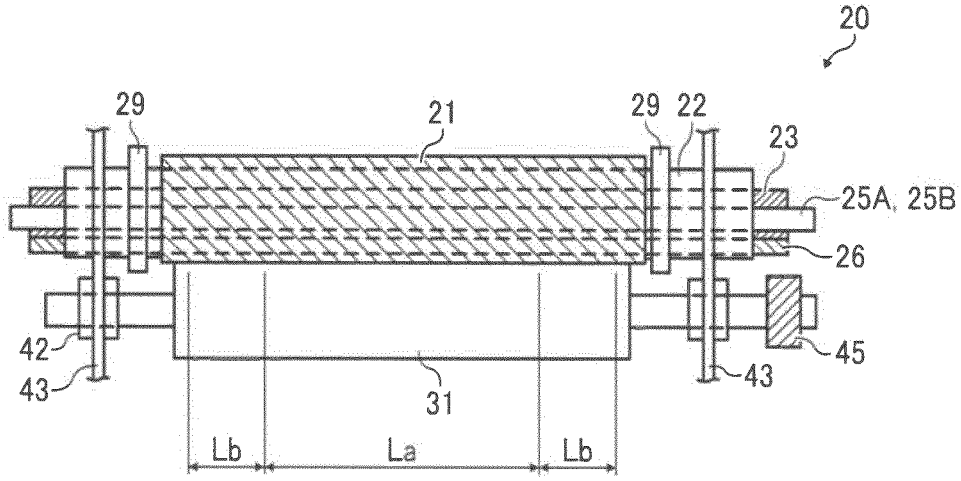
FIG. 3 is a transverse view schematically illustrating the fixing device of FIG. 2.

FIGS. 2 and 3 are end-on, axial cutaway and transverse views, respectively, schematically illustrating the fixing device 20 incorporated in the image forming apparatus 1 according to this patent specification.

As shown in FIGS. 2 and 3, the fixing device 20 includes a rotatable fuser belt 21 looped into a generally cylindrical configuration for rotation around a hollow, generally cylindrical, stationary metal roller 22, and a rotatable, generally cylindrical pressure roller 31 held in pressure contact with an outer surface of the fuser belt 21. The metal roller 22 and the pressure roller 31 are disposed parallel to each other along an axial, longitudinal direction between a pair of sidewalls 43 of the fixing device 20.

The pressure roller 31 has two ends rotatably held on the sidewalls 43 via a pair of bearings 42, one of which is connected to a drive motor, not shown, via a set of one or more gears 45 outside the sidewalls 43 for imparting a rotational force to the roller 31.

Inside the loop of the fuser belt 21, a stationary, fuser pad 26 extends in the longitudinal direction with two longitudinal ends fixed to the sidewalls 43. The fuser pad 28 is pressed against the pressure roller 31 through the fuser belt 21 to define a fixing nip N therebetween while establishing frictional contact with the an inner surface 21*a* of the rotating belt 21. The metal roller 22 faces the inner surface 21*a* of the looped belt 21 except where the fuser pad 26 forms the fixing nip N, with its two ends fixed to the sidewalls 43 and provided with a pair of annular flanges 29 fitted therearound to prevent the belt 21 from displacing in the longitudinal direction.

Disposed within the metal roller 22 is a stationary reinforcing member 23 extending in the longitudinal direction with two longitudinal ends fixed to the sidewalls 43 to reinforce the length of the fuser pad 26. Also disposed therein is a stationary heating assembly 25 formed of a pair of first and second elongated heaters 25A and 25B, each having two longitudinal ends fixed to the sidewalls 43, to irradiate the inner side 22*a* of the roller 22 for heating the fuser belt 21. A pair of thermometers 40A and 40B are disposed adjacent to the surface of the fuser belt 21 to detect the temperature of the belt surface for controlling operation of the heaters 25A and 25B.

During operation, the fixing device 20 activates the roller drive motor and the heaters 25A and 25B as the image forming apparatus 1 is powered up. Upon activation, the heaters 25A and 25B start heating the metal roller 22 by radiation, which eventually heats the fuser belt 21 to a processing temperature by conduction. At the same time, the motor-driven pressure roller 31 starts rotation clockwise in FIG. 2 in frictional contact with the fuser belt 21, which in turn rotates around the metal roller 22 counterclockwise in FIG. 2.

Then, a recording sheet S with an unfixed, powder toner image T enters the fixing device 20 with its printed side brought into contact with the fuser belt 21 and the other side with the pressure roller 31. Upon reaching the fixing nip N, the recording sheet S moves along the rotating surfaces of the belt 21 and the roller 31 in the direction of arrow Y10 perpendicular to the axial direction, substantially flat and erect along surfaces of guide plates, not shown, disposed along the sheet conveyance path.

At the fixing nip N, the fuser belt 21 heats the incoming sheet S to fuse and melt the toner particles T, while the pressure roller 31 presses the sheet S against the fuser pad 26 held stationary by the reinforcing member 23 to cause the molten toner T to settle onto the sheet surface. As the toner image T is thus fixed in place through the fixing nip N, the recording sheet S is forwarded to exit the fixing device 20 in the direction of arrow Y11.

In the present embodiment of the fixing device 20, the pressure roller 31 comprises a cylindrical rotatable body approximately 30 mm in diameter, formed of a hollow, cylindrical metal core 32 covered with an outer layer 33 of elastic material, such as foamed or solid silicone rubber, fluorine rubber, or the like, and optionally, with an additional coating of a release agent, such as perfluoroalkoxy (PFA), polytetrafluoroethylene (PTFE), or the like, deposited on the elastic layer 33. Further, the pressure roller 31 may have a heating element, such as a halogen heater, within the interior of the hollow roller core 32.

Forming the roller outer layer 33 with sponge material is advantageous, since it prevents excessive nip pressure, which would otherwise cause the metal roller 22 to substantially bend away from the pressure roller 31 at the fixing nip N. Another advantage is that it provides favorable thermal insulation at the fixing nip N to prevent heat transfer from the fuser belt 21 to the pressure roller 31, leading to enhanced heating efficiency in the fixing device 20.

Although the fuser belt 21 and the pressure roller 31 are of a substantially identical diameter in the embodiment depicted in FIGS. 2 and 3, instead, it is possible to provide the cylindrical fixing members 21 and 31 with different diameters, in particular, the fuser belt 21 with a relatively small diameter and the pressure roller 31 with a relatively large diameter. Forming the fuser belt 21 with a diameter smaller than that of the pressure roller 31 translates into a greater curvature of the fuser belt 21 than that of the pressure roller 31 at the fixing nip N, which effects good stripping of a recording sheet from the fuser belt 21 upon exiting the fixing nip N.

The fuser belt 21 comprises a thin, multi-layered, looped flexible belt approximately 1 mm or less in thickness and approximately 15 to 120 mm in diameter in its generally cylindrical looped shape (with an inner diameter of about 30 mm in the present embodiment), the overall length of which is formed of a substrate covered with an intermediate elastic layer and an outer release coating deposited thereon, one atop another.

Specifically, the belt substrate may be a layer of metal or resin, such as nickel, stainless steel, polyimide, or the like, approximately 30 to 50 μm in thickness. The intermediate elastic layer may be a deposit of rubber, such as solid or foamed silicone rubber, fluorine resin, or the like, approximately 100 to 300 μm in thickness. The outer coating may be a deposit of a release agent, such as tetra fluoro ethylene-perfluoro alkylvinyl ether copolymer or PFA, PTFE, polyimide (PI), polyetherimide (PEI), polyethersulfone (PES), or the like, approximately 10 to 50 μm in thickness.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. Further, the release coating layer provides good stripping of toner from the belt surface to ensure reliable conveyance of recording sheets S through the fixing nip N.

Inside the loop of the fuser belt 21, various fixing members are disposed stationary, (i.e., fixed in position, and do not rotate as the fuser belt 21 rotates), including the metal roller 22, the reinforcing member 23, the heating assembly 25, and the fuser pad 26, as well as a heat insulating member 27 interposed between the fuser pad 26 and the heating assembly 25, and a shape retaining stay 28 disposed on the metal roller 22, not specifically shown in FIGS. 2 and 3.

The metal roller 22 comprises a generally cylindrical, thin-walled hollow member formed by bending a thin sheet of thermally conductive material into a rolled configuration, which in the present embodiment has an open-concave side formed by spacing a pair of opposed ends of the rolled sheet from each other and then turning the ends inward to define a side slot extending in the longitudinal direction. The metal roller 22 accommodates the fuser pad 26 inserted in its side slot to form the fixing nip N, with the heat insulating member 27, not shown in FIGS. 2 and 3, disposed between adjoining walls of the roller 22 and the pad 26 for insulation, and faces the inner surface 21*a* of the fuser belt 22 except at the fixing nip N.

The metal roller 22 may be made of a conductive material with a thickness not exceeding 0.2 mm, preferably, not exceeding 0.1 mm. Forming the metal roller 22 with a wall thickness not exceeding 0.2 mm is desirable for promptly heating the roll circumference to a processing temperature during operation, which leads to reduced warm-up time and high thermal efficiency of the fixing device 20. Examples of suitable conductive material include metals, such as stainless steel, nickel, aluminum, and iron, of which ferritic stainless steel is preferable due to its relatively low volumetric heat capacity (i.e., specific heat capacity multiplied by density) leading to high thermal efficiency of the fixing device 20.

In the present embodiment, the metal roller 22 is formed of a commercially available ferritic stainless steel, SUS430, approximately 0.1 mm thick, which may be readily obtained through suitable metal working processes.

It is to be noted that although the present embodiment depicts the metal roller 22 as a generally cylindrical member, alternatively the metal roller 22 may be formed in various configurations, including cylinders, prisms, and composite shapes, and may have one or more slits along its circumference according to the intended application of the fixing device 20.

Preferably, there is a gap or clearance A not exceeding 1 mm between the inner circumference of the fuser belt 21 and the outer circumference of the metal roller 22 except at the fixing nip N. Maintaining the gap A between the fuser belt 21 and the metal roller 22 prevents the elastic belt surface from premature wear caused by excessive rubbing against the metal roller surface. Moreover, holding the belt-to-roll gap A within an adequate range ensures efficient heat transfer from the metal roller 22 to the fuser belt 21, which prevents failures caused by insufficient heating at the fixing nip N, and also maintains the flexible belt 21 in a generally cylindrical configuration around the metal roller 22 for preventing deformation and concomitant deterioration and breakage of the belt 21.

In addition, the fuser belt 21 and the metal roller 22 are provided with a lubricating agent, such as fluorine grease, deposited between their adjoining surfaces. The lubricant reduces friction at the interface to prevent wear and tear on the fuser belt 21 even when operated in continuous frictional contact with the metal roller 22.

The heating assembly 25 has the first and second heaters 25A and 25B each formed of a radiation heating element, such as a halogen heater or carbon heater. The first heater 25A is configured to heat a longitudinal center of the metal roller 22, whereas the second heater 25B is configured to heat two longitudinal ends of the metal roller 22. Specific configurations of the heaters 25A and 25B will be described later in more detail.

The thermometers 40A and 40B each comprises a thermistor or other suitable temperature sensor. The first thermometer 50A is configured to sense the temperature of the fuser belt 21 where the belt 21 overlaps the longitudinal center of the metal roller 22, whereas the second thermometer 50B is configured to sense the temperature of the fuser belt 21 where the belt 21 overlaps the two longitudinal ends of the metal roller 22. Specific configurations of the thermometers 40A and 40B will be described later in more detail.

To warm up the fixing device 20, the radiation heating assembly 25 heats the metal roller 22 directly through radiation, and the fuser belt 21 indirectly through conduction from the metal roller 22 being heated. That is, the heaters 25A and 25B irradiate the inner circumference of the metal roller 22, which then conducts heat to those portions of the fuser belt 21 in contact with the roller circumference (i.e., outside the fixing nip N). As the fuser belt 21 rotates, this results in uniformly heating the entire length of the rotating belt 21 sufficiently for fusing toner at the fusing nip N.

Such heating is controlled by the image forming apparatus 1 regulating a power supply to the respective heaters 25A and 25B according to readings of the thermometers 40A and 40B sensing temperatures of the outer circumference of the fuser belt 21 to maintain the belt surface at a desired processing temperature.

Thus, the fuser belt 21 has its length heated substantially continuously and uniformly by conduction from the outer circumference of the metal roller 22 being internally heated by irradiation with the heaters 25. Compared to directly and locally heating portions of a fuser member, such indirect continuous heating can warm up the entire length of the fuser belt 21 swiftly and efficiently with a relatively simple configuration, which allows the fixing device 20 to operate at higher processing speeds without causing image defects due to premature entry of recording sheets into the fixing nip N. This leads to a reduction in warm-up time and first-print time required for completing an initial print job upon startup, while maintaining a compact size of the image forming apparatus 1 incorporating the fixing device 20.

Figure 4:
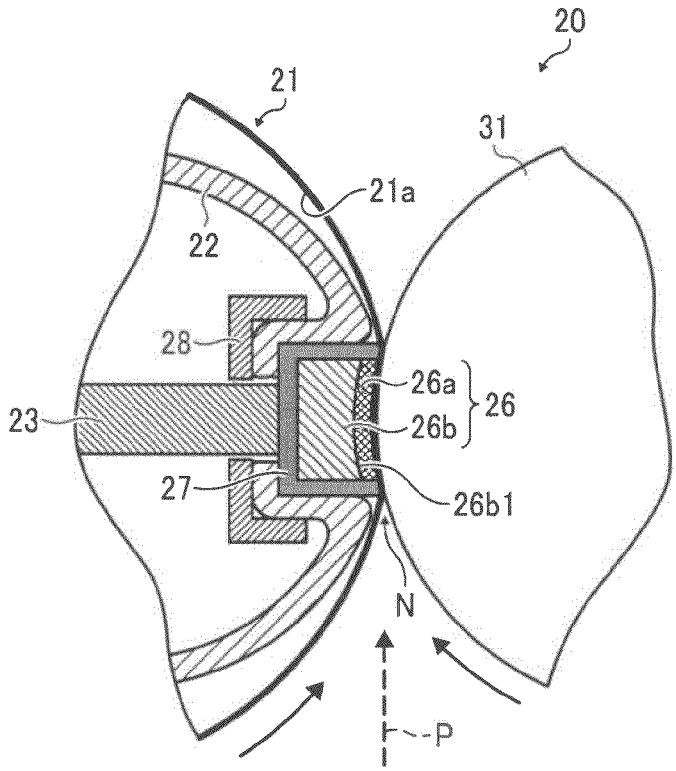
FIG. 4 is an enlarged, end-on, axial cutaway view illustrating the fixing device of FIG. 2.

With additional reference to FIG. 4, which is an enlarged cross-sectional view schematically illustrating the fixing nip N, the fixing device 20 is shown with details of the fuser pad 26, the reinforcing member 23, the heat insulating member 27, and the shape retaining stay 28.

The fuser pad 26 comprises an elongated piece formed of a rigid base 26*b* with its one side 26*b*1 covered with a surface layer 26*a* of suitable material to define an outer surface to establish sliding contact with the pressure roller 31 through the fuser belt 21. The outer, sliding contact surface of the fuser pad 26 is available in various configurations according to particular applications of the fixing device 20.

For example, the fuser pad 26 may have a slightly concave contact surface with a curvature similar to that of the circumference of the pressure roller 31. The concave contact surface allows a recording sheet S to conform to the curvature of the pressure roller 31 during passage through the fixing nip N, which ensures reliable conveyance of the sheet S without adhering to and wrapping around the fuser belt 21 upon exiting the fixing nip N.

Alternatively, instead of the concave configuration, the fuser pad 26 may have a substantially flat contact surface. The flat contact surface causes a recording sheet S to remain straight and hence intimately contact the fuser belt 21 within the fixing nip N, resulting in efficient fusing performance, while allowing for good stripping of the recording sheet S from the fuser belt 21 which exhibits a curvature larger at the exit of the fixing nip N than within the fixing nip N.

The rigid base 26*b* of the fuser pad 26 is formed of sufficiently stiff material, such as rigid metal or ceramic, to securely form the fixing nip N without bending or bowing away from the fixing nip N under pressure from the pressure roller 31.

As mentioned, the fuser pad 26 is provided in the side slot of the metal roller 22, that is, where the roller circumference extends away from the pressure roller 31, or pressure exerted at the fixing nip N. Having the side slot extending away from the pressure roller 31 and provided with the separate fuser pad 26, the open-sided metal roller 22 can operate substantially in isolation from the pressure roller 31, and thus prevented from bending or bowing away from the fixing nip N under pressure applied by the pressure roller 31.

Such capability to protect the metal roller 22 against deformation under nip pressure is particularly effective in a configuration where the metal roller 22 is extremely thin-walled, with its wall thickness approximately 0.2 mm or less, and therefore is low in strength, for obtaining high thermal efficiency in heating the fuser belt 21. Protection against roller deformation in turn protects the fuser belt 21 against damage and failure, such as slipping off the metal roller or inconsistent heating due to non-uniform contact between the fuser belt and the metal roller, resulting in proper operation of the fixing device 20 according to this patent specification.

The reinforcing member 23 comprises an elongated piece of rigid material with its length substantially equal to that of the fuser pad 26. In the present embodiment, the reinforcing member 23 extends across a width of the generally cylindrical cross-section of the metal roller 22 to divide the roller interior generally into two compartments.

The reinforcing member 23 serves to strengthen and support the fuser pad 26 in position subjected to pressure from the pressure roller 31 in the fixing nip N. That is, the reinforcing member 23 thrusts the fuser pad 26 against the pressure roller 31 through the fuser belt 21, so that the fuser pad 26 does not substantially displace or deform under nip pressure.

Preferably, the reinforcing member 23 is formed of metal, such as stainless steel or iron, which exhibits sufficient stiffness required to support the fuser pad 26 in position and shape. Further, the reinforcing member 23 may have its rear side (i.e., the side that faces the heaters 25 upon installation in the hollow interior of the metal roller 22) partially or entirely coated with a thermal insulation coating, or subjected to a bright annealing or mirror polish during manufacture. Such surface treatment enables the reinforcing member 23 to repel or reflect radiation from the heater 25, which allows the metal roller 22 to efficiently absorb heat generated by the heating assembly 25 for transfer to the fuser belt 21, leading to enhanced heating efficiency in the fixing device 20.

The heat insulating member 27 comprises a layer of thermally insulative material, such as sponge rubber and porous ceramic, that covers those surfaces of the fuser pad 26 facing the metal roller 22, i.e., except for the sliding contact surface facing the inner surface 21*a* of the belt 22.

Thermally insulating the fuser pad 26 prevents the pressure roller 31 from damage or deformation due to intense heating even where the fixing device 20 is "on-demand", i.e., capable of promptly executing an incoming print job after warm-up, in which the fuser belt 21 has its almost entire length retained adjacent to the surface of the heated metal roller 22 for uniformly heating even while idle (i.e., when the fixing device 20 waits for a print job).

In a conventional on-demand fuser configuration that intensively heats a pressure roller compressed under pressure at a fixing nip during warm-up, the pressure roller can develop thermal degradation or permanent compressive deformation depending on the elastic material used. Thermal degradation results in a reduced lifetime of the pressure roller. On the other hand, permanent compressive deformation translates into a locally concave surface of the pressure roller, which may result in defective performance of the fixing device, such as imperfections in prints and/or abnormal noise during rotation of the fixing roller, due to variations in width and intensity of the fixing nip formed by the concave roller surface.

By contrast, the fixing device 20 according to this patent specification is free from those problems associated with thermal damage of the pressure roller, wherein the heat insulating member 27 prevents heat transfer from the metal roller 22 to the fuser pad 26, which eventually prevents the elastic pressure roller 31 from intense heating at the fixing nip N where the pressure roller 31 is compressed under nip pressure.

Further, providing the heat insulating member 27 prevents thermal degradation of the lubricant at the interface between the fuser pad 26 and the fuser belt 21. The lubricating agent disposed where the fuser pad 26 contacts the inner surface 21*a* of the fuser belt 21 can deteriorate as a result of high pressure combined with high temperature, which translates into defective operation of the fixing device, such as the fuser belt slipping off the metal roller. The heat insulating member 27, preventing heat transfer from the metal roller 22 to the fuser pad 26, protects the lubricant from intense heating, thereby preventing problems associated with thermal degradation of the lubricant at the fixing nip N.

Moreover, provision of the heat insulating member 27 ensures proper sheet conveyance through the fixing nip N. With the heat insulating member 27 thermally isolating the fuser pad 26, the fuser belt 21 remains unheated at the fixing nip N relative to other portions along the circumference of the metal roller 22. Such absence of heating in the fixing nip N results in the temperature of a recording sheet S gradually decreasing as it passes through the fixing nip N, so that toner particles carried on the recording sheet S become colder, and therefore less viscous, at the exit of the fixing nip N.

Reduced viscosity of the toner image means a reduced adhesion of the toner image to the fuser belt 21 as the recording sheet S exits the fixing nip N. This results in good stripping of the printed recording sheet S from the fuser belt 21 at the exit of the fixing nip N, which prevents failures of the fixing device 20, such as jams at the fixing nip N due to recording sheets wrapping around the fuser belt, or contamination of the fuser belt with toner migrating from the printed face of the recording sheet.

The shape retaining stay 28 comprises a mechanical stay of suitable shape that conforms to the turned longitudinal edges of the metal roller 22 forming the side slot. The shape retaining stay 28 is press-fitted to the side slot of the metal roller 22 from within the roller interior to clamp together the turned longitudinal edges of the metal roller 22. The shape retaining stay 28 serves to retain the generally cylindrical shape of the metal roller 22, and in particular, prevents the thin-walled roller 22 (e.g., a 0.1 mm-thick stainless steel roller in the present embodiment) from deforming due to elastic recovery of the roller material, a property known in the art as "springback".

Springback occurs where the rolled metal sheet tends to recover its original flat shape after bending, which causes the open-sided heat pipe to lose its generally cylindrical shape with the gap between the opening edges wider than that intended. If not corrected, deformation of the metal roller can cause various defects due to interference or mis-coordination between the fuser belt and the metal roller, such as the belt getting damaged or making noise by excessively rubbing against the metal roller, or running out of track by slipping off the roller surface.

The shape retaining stay 28 clamping together the opening edges of the metal roller 22 effectively prevents the rolled metal sheet from springback. Such protection against roller deformation provided by the shape retaining stay 28 ensures reliable operation of the fixing device 20 using the thin-walled metal roller 22.

Figure 5:
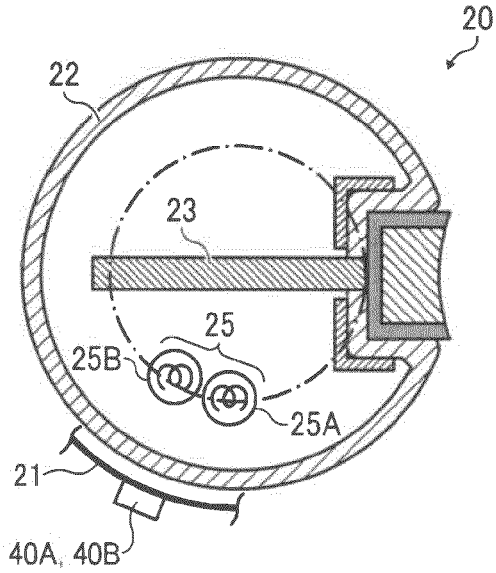
FIG. 5 is an end-on, axial cutaway view schematically illustrating one embodiment of a heating assembly employed in the fixing device according to this patent specification.

FIG. 5 is an end-on, axial cutaway view schematically illustrating one embodiment of the heating assembly 25 in use with the fixing device 20 according to this patent specification.

As shown in FIG. 5, the first and second heaters 25A and 25B are both accommodated within one of the two compartments of the roller interior created by the reinforcing member 23 extending across the substantially circular cross-section of the metal roller 22. The first and second heaters 25A and 25B are arranged in juxtaposition with each other along the inner circumference of the metal roller 22, each extending in the longitudinal direction along the length of the metal roller 22. Facing the heater assembly 25 via thicknesses of the metal roller 22 and the fuser belt 21, the first and second thermometers 40A and 40B are disposed overlapping each other in the longitudinal direction.

Figure 6A:
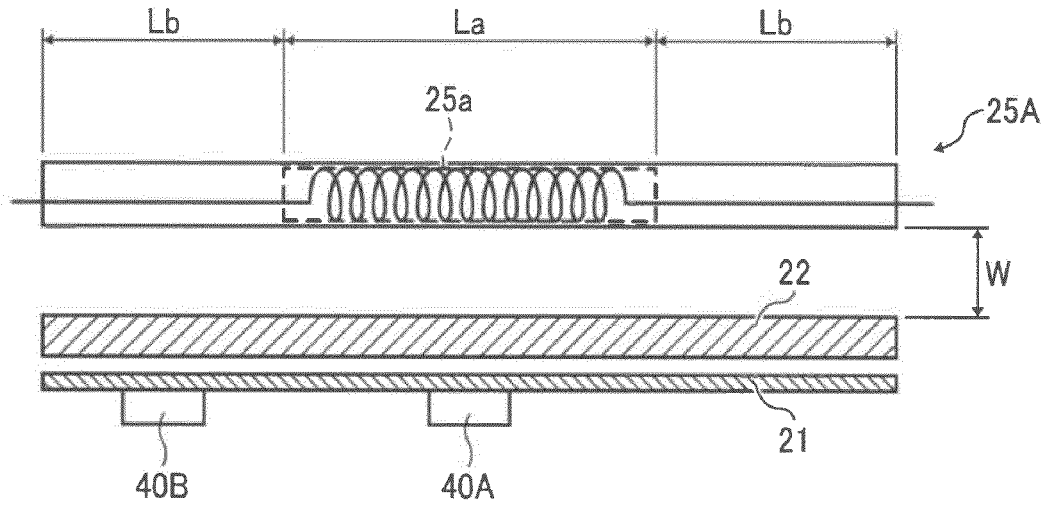
FIGS. 6A and 6B are transverse cross-sectional views schematically illustrating first and second heaters, respectively, included in the heating assembly of FIG. 5.
Figure 6B:
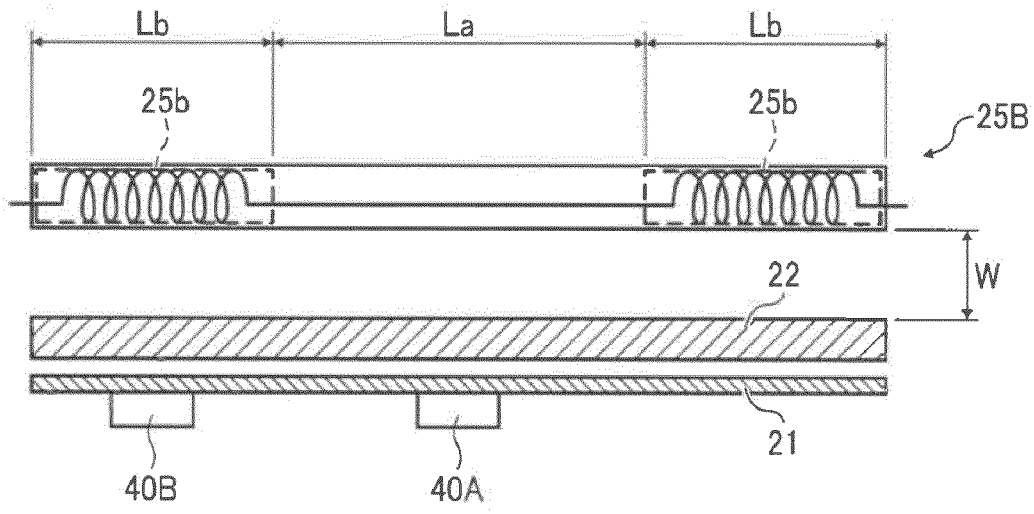

FIGS. 6A and 6B are transverse cross-sectional views schematically illustrating the first and second heaters 25A and 25B extending along the length of the metal roller 22.

As shown in FIG. 6A, the first heater 25A has a heating element 25*a* having a first length La and positioned to face a longitudinal center of the metal roller 22. The first thermometer 40A is disposed to face a longitudinal center of the fuser belt 21, overlapping the longitudinal center of the metal roller 22, to sense the temperature of the fuser belt 21 heated by the first heater 25A.

On the other hand, as shown in FIG. 6B, the second heater 25B has a heating element 25*b* divided into two separate sections, each having an identical second length Lb and each positioned to face a longitudinal end on one side of the longitudinal center of the metal roller 22. The second thermometer 40B is disposed to face a longitudinal end of the fuser belt 21, overlapping one longitudinal end of the metal roller 22, to sense the temperature of the fuser belt 21 heated by the second heater 25B.

The first and second lengths La and Lb may be determined depending on specific application of the fixing device 20. For example, in the present embodiment, the total length of the first and second heating elements 25*a* and 25*b* along the length of the metal roller 22 (i.e., La+2Lb) is substantially equal to a maximum compatible width of recording sheet S that the fixing device 20 can accommodate in the fixing nip N, and the length of the first heating element 25*a* (i.e., La) is substantially equal to another compatible width of recording sheet S smaller than the maximum compatible sheet width.

Although not depicted in the drawing, each of the heaters 25A and 25B is provided with dedicated wiring extending outward from the longitudinal ends of the fixing device 20 for connection to a controlled power supply included in the image forming apparatus 1. Such separate wiring allows the heaters 25A and 25B to switch on and off independently of each other to heat the associated areas of the metal roller 22 separately, as the image forming apparatus 1 supplies power controlled according to readings of the first and second thermometers 40A and 40B.

In such a configuration, the fixing device 20 can selectively heat an operating area of the metal roller 22 to a desired temperature, leaving a non-operating area of the metal roller 22 unheated, with the first and second heaters 25A and 25B switching on and off independently from each other. The term "operating area" as used herein refers to a longitudinal extent that overlaps or contacts a recording sheet S being processed through the fixing nip N, and the term "non-operating area" refers to a longitudinal extent other than the extent of the operating area. Such selective heating of the metal roller 22 prevents the non-operating area of the fuser belt 21 from excessive heating even where the fixing device 20 processes recording sheets S of different sizes during operation.

More specifically, the fixing device 20 may activate either both heaters 25A and 25B or only the first heater 25A according to the size of a recording sheet S processed through the fixing nip N, with the controlled power supply switching on and off the activated heater(s) independently of each other so that the readings of the thermometers 40A and 40B reach balanced, operating temperatures. A sheet size sensor may be provided at the sheet conveyance path to detect the size of recording sheet S being forwarded to the fixing device 20, according to which the image forming apparatus 1 can determine which heater to activate for selectively heating a desired operating area of the metal roller 22.

For example, consider cases where the total length La+2Lb of the first and second heating elements 25*a* and 25*b* is approximately 297 mm, which equals the length of the shorter edge of an A3-size copy sheet, and the length La of the first heating portion 25*a* is approximately 210 mm, which equals the length of the shorter edge of an A4-size copy sheet.

When processing an A3-size copy sheet with its longer edge directed along the sheet conveyance path (i.e., with its shorter edges as the leading and trailing edges), the fixing device 20 has both of the first and second heaters 25A and 25B supplied with power for activation. Upon activation, the heaters 25A and 25B warm a relatively large operating area extending across the longitudinal center and the two longitudinal ends of the heat roller 22, covered by the total length La+2Lb of the first and second heating elements 25*a* and 25*b*. The heaters 25A and 25B are independently switched on and off so as to maintain the longitudinal center and the longitudinal ends of the metal roller 22 at desired operating temperatures.

By contrast, when processing an A4-size copy sheet with its longer edge directed along the sheet conveyance path (i.e., with its shorter edges as the leading and trailing edges), the fixing device 20 has the first heater 25A supplied with power for activation and the second heater 25B deactivated. Upon activation, the heater 25A warms a relatively small operating area extending across the longitudinal center of the heat roller 22, covered by the length La of the first heating element 25*a*.

As for recording sheets S other than A4-size and A3-size copy sheets, the fixing device 20 processes those larger than A4 and smaller than A3 in a manner similar to that for an A3-size copy sheet, and those smaller than A4 in a manner similar to that for an A4-size copy sheet.

In addition, the fixing device 20 may have the first and second heaters 25A and 25B both supplied with power regardless of the size of recording sheet S in use, when the image forming apparatus 1 starts up with the fuser belt 21 remaining at a temperature significantly lower than a rated operating temperature (e.g., upon power-on after a certain period of power-off). Heating with the heaters 25A and 25B both activated allows for prompt heating of the fuser belt 21, which reduces a period of time required during startup of the fixing device 20.

Thus, the fixing device 20 according to this patent specification can selectively heat an operating area of the metal roller 22 with the first and second heaters 25A and 25B independently controlled to heat different portions of the metal roller 22 depending on the size of recording sheet S in use. Such selective heating prevents non-operating areas of the metal roller 22 and the fuser belt 21 from excessively heating even where the fixing device 20 processes recording sheets S of different sizes through the fixing nip N.

Providing selective heating of the metal roller 22 with the two elongated heaters 25A and 25B arranged along the inner circumference of the metal roller 22 is structurally efficient. This is particularly true in the present embodiment of the fixing device 20 where the heating equipment is disposed within a limited space inside the metal roller 22, that is, within the compartment of the roller interior created by the reinforcing member 23 extending across the substantially circular cross-section of the metal roller 22.

Compare the heating assembly 25 with a single elongated heater composed of a series of multiple relatively short heating elements. When disposed within a narrow compartment of a metal roller, the composite elongated heater may have a mass of wires closely spaced as each heating element is provided with dedicated wiring for connection with a controlled power supply. By contrast, the two elongated heaters 25A and 25B arranged along the inner circumference of the metal roller 22 are provided with only two sets of wiring, which does not require excess space within the metal roller 22, and therefore, is structurally efficient.

Also, the heating assembly 25 configured with two heaters is preferred to configurations with three or more heaters in terms of cost and space required for installing the heating equipment. This is particularly true in the present embodiment of the fixing device 20 where the relatively small metal roller 22 defines a relatively narrow interior space, which is partitioned into two even smaller compartments with the reinforcing member 23, in one of which the heater assembly 25 is accommodated.

With continued reference to FIGS. 5, 6A, and 6B, the first and second heaters 25A and 25B are shown with their heating elements 25*a* and 25*b* offset from each other and spaced from the adjoining surface of the metal roller 22. Preferably, the first and second heaters 25A and 25B are positioned at an equal distance W from the inner circumference of the metal roller 22. That is, the first and second heaters 25A and 25B have their longitudinal axes lying on a single imaginary circle (represented by a broken line in FIG. 5) concentric with the substantially circular cross-section (i.e., axis) of the metal roller 22.

Figure 7A:
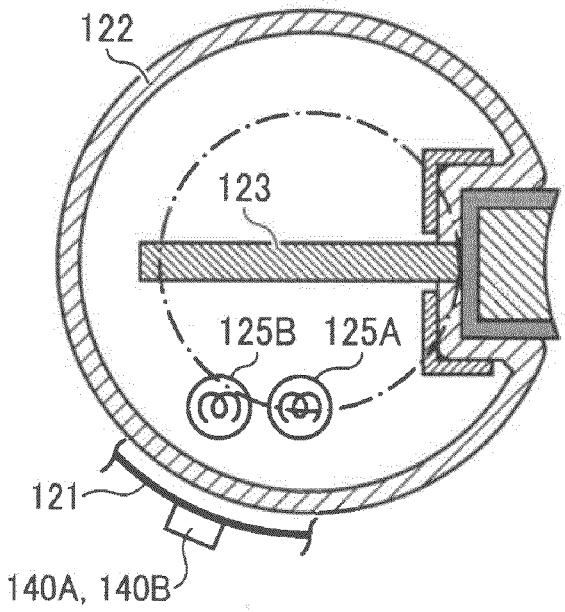
FIGS. 7A and 7B are end-on, axial cutaway views schematically illustrating examples of a heating assembly for comparison with the fixing device of FIG. 5.

Referring to FIG. 7A, for comparison, consider a pair of elongated heaters 125A and 125B disposed at different distances from the inner circumference of a metal roller 122, for example, with the second heater 125B closer to the roller circumference than the first heater 125A. In this case, the metal roller 122 has its longitudinal ends heated more intensively than its longitudinal center, which eventually results in a non-uniform distribution of heat across the width of a fuser belt 121 being heated by the metal roller 122.

By contrast, the first and second heaters 25A and 25B positioned at the same distance W from the inner circumference of the metal roller 22 can uniformly heat the length of the metal roller 22, so as to prevent inconsistent heating of the fuser belt 21. Uniform distribution of heat across the fuser belt 22 allows the fixing device 20 to uniformly heat a recording sheet S, leading to good, uniform appearance of a printed image processed through the fixing nip N.

With particular reference to FIG. 5, the first and second heaters 25A and 25B are shown within the interior of the metal roller 22 partitioned by the reinforcing member 23. Preferably, of the two compartments of the roller interior created by partitioning with the reinforcing member 23, the first and second heaters 25A and 25B are disposed within that which is located upstream of the fixing nip N (i.e., on the side from which the rotating fuser belt 21 enters the fixing nip N during operation).

Such positioning of the heaters 25A and 25B provides high thermal efficiency of the fixing device 20. It is known that the fuser belt 21 exhibits greater tension upstream than downstream of the fixing nip N, so that the gap or clearance created between the adjoining surfaces of the fuser belt 21 and the metal roller 22 upstream of the fixing nip N during operation is relatively small (i.e., smaller than originally designed). Therefore, heating the metal roller 22 with the heaters 25A and 25B positioned upstream rather than downstream of the fixing nip N results in optimum efficiency of heat transfer from the roller surface to the belt surface.

In addition, the heaters 25A and 25B disposed upstream of the fixing nip N can heat the fuser belt 21 immediately before entering the fixing nip N, so that little if any change may occur in the temperature of the heated belt 21 as it enters the fixing nip N. This facilitates temperature control through the heaters 25A and 25B according to readings of the thermometers 40A and 40B, which allows for ready adjustment of the process temperature of the fixing device 20.

With continued reference to FIG. 5, the first and second thermometers 40A and 40B are disposed at a particular point relative to the outer circumference of the metal roller 22 so as to overlap each other when viewed in the axial direction. The thermometers 40A and 40B are disposed facing the heaters 25A and 25B so that neither of the heaters 25A and 25B is interposed between each thermometer and each heater. That is, the first thermometer 40A faces the first heater 25A through thicknesses of the metal roller 22 and the fuser belt 21 without interception by the second heater 25B, whereas the second thermometer 40B faces the second heater 25B through thicknesses of the metal roller 22 and the fuser belt 21 without interception by the first heater 25A.

Figure 7B:
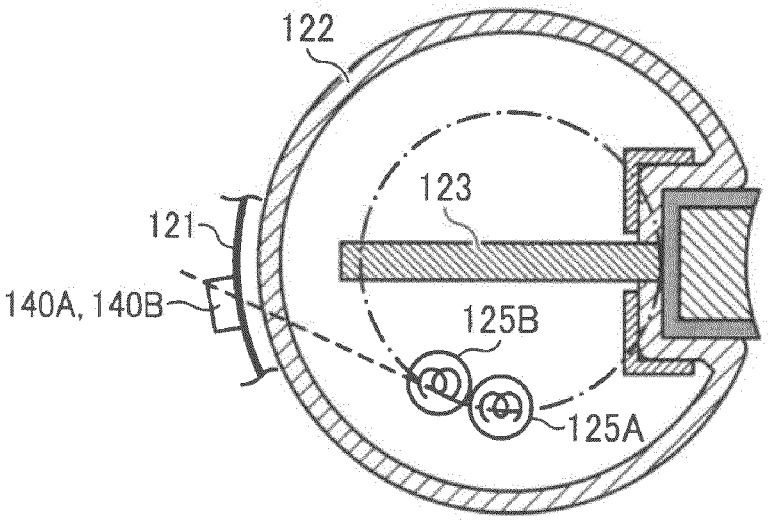

Referring to FIG. 7B, again for comparison, consider a pair of thermometers 140A and 140B disposed at an angle to a pair of heaters 125A and 125B, so that one heater 125B is interposed between each thermometer 140 and the other heater 125A. In this case, heat or infrared light radiated from the heater 125A is intercepted by the interposed heater 125B before reaching the thermometer 140A. This adversely affects precision of the thermometer 140A detecting temperature of the fuser belt 121, as the thermometers 140 perform temperature detection based on measurement of the radiation from the heaters 125.

By contrast, the thermometers 40A and 40B disposed facing the pair of heaters 25A and 25B enables the thermometers 40A and 40B to detect radiation from the heaters 25A and 25B without interception, so as to provide measurements that faithfully represent the temperature of those portions of the metal roller 22 directly heated through irradiation by the respective heaters 25A and 25B. This provides high accuracy with which the image forming apparatus 1 controls the heaters 25A and 25B according to the readings of the thermometers 40A and 40B, leading to uniform heating of the width of the fuser belt 21.

Hence, the fixing device 20 according to this patent specification can operate with extremely short warm-up time and first-print time required to process an initial print job at startup, while exhibiting high immunity to failures caused by insufficient heating of the fuser belt in high speed application, owing to the thermally conductive metal roller 22 swiftly and uniformly heating the fuser belt 23.

Stable and proper functioning of the fixing device 20 is ensured by the heating assembly 25 formed of the first and second heaters 25A and 25B arranged in juxtaposition with each other along the inner circumference of the metal roller 22, wherein the first heater 25A dedicated for heating the longitudinal center of the metal roller 22 and the second heater 25B dedicated for heating the longitudinal ends of the metal roller 22 can be controlled independently of each other to selectively heat an operating area of the metal roller 22, which prevents a non-operating area of the fuser belt 21 from damage and deformation due to intensive heating during operation.

Numerous additional modifications and variations are possible in light of the above teachings.

For example, although the embodiments described above employ a multi-layered fuser belt formed of a substrate combined with elastic and releasing layers, the fixing device according to this patent specification may be configured with an endless belt or film of any suitable material, such as any one or combination of polyimide, polyamide, fluorine resin, and metal, looped for rotation around the heat roll while heated. In any such configuration, the fixing device provides reliable, high-speed imaging performance without thermally deforming or damaging the fuser belt.

Further, although the embodiments described above employ contact thermometers or thermistors to detect temperature of the fuser belt, the fixing device according to this patent specification may be configured with any suitable temperature detector including non-contact thermometers such as thermopiles. In any such configuration, the fixing device provides reliable, high-speed imaging performance without thermally deforming or damaging the fuser belt.

It is therefore to be understood that, within the scope of the appended claims, the disclosure of this patent specification may be practiced otherwise than as specifically described herein.

What is claimed is:

1. A fixing device comprising:

a hollow, stationary metal roller extending in a longitudinal direction, an inner circumference thereof subjected to heating;

a flexible fuser belt looped for rotation around the metal roller to transfer heat radially outward from the heated metal roller;

a rotatable pressure member extending opposite the metal roller in the longitudinal direction, with the fuser belt interposed between the metal roller and the rotatable pressure member;

a fuser pad held stationary inside the loop of the fuser belt to press against the pressure member through the fuser belt to form a fixing nip through which a recording medium is passed to fix a toner image thereupon under heat and pressure;

a reinforcing member disposed stationary within the roller interior to reinforce the fuser pad; and a heating assembly disposed stationary within the roller interior to heat the metal roller from inside, the heating assembly including:

a first heater having a heating element thereof positioned facing a longitudinal center of the metal roller; and a second heater having a heating element thereof positioned facing two longitudinal ends of the metal roller, the first and second heaters being arranged in juxtaposition with each other along the inner circumference of the metal roller.

2. The fixing device according to claim 1, wherein the first and second heaters are disposed at an equal distance from the inner circumference of the metal roller.

3. The fixing device according to claim 1, wherein the first and second heaters are disposed parallel to and offset from each other so as not to overlap in the longitudinal direction.

4. The fixing device according to claim 1, further comprising:

a first thermometer to detect temperature of the fuser belt where the fuser belt overlaps the longitudinal center of the metal roller; and a second thermometer, overlapping the first thermometer in the longitudinal direction, to detect temperature of the fuser belt where the fuser belt overlaps the longitudinal ends of the metal roller, the first thermometer facing the first heater through thicknesses of the metal roller and the fuser belt without interception by the second heater, the second thermometer facing the second heater through thicknesses of the metal roller and the fuser belt without interception by the first heater.

5. The fixing device according to claim 1, wherein the reinforcing member partitions the interior of the metal roller generally into two compartments, one upstream and the other downstream of the fixing nip in a direction of rotation of the fuser belt, and the first and second heaters are both accommodated in the upstream compartment of the roller interior.

6. The fixing device according to claim 1, wherein each of the first and second heaters switches on and off independently of the other according to width of a recording medium being processed through the fixing nip.

7. An image forming apparatus comprising:

an electrophotographic imaging unit to form a toner image on a recording medium; and a fixing device to fix the toner image in place on the recording medium, the fixing device including:

a hollow, stationary metal roller extending in a longitudinal direction, an inner circumference thereof subjected to heating;

a flexible fuser belt looped for rotation around the metal roller to transfer heat radially outward from the heated metal roller;

a rotatable pressure member extending opposite the metal roller in the longitudinal direction, with the fuser belt interposed between the metal roller and the rotatable pressure member;

a fuser pad held stationary inside the loop of the fuser belt to press against the pressure member through the fuser belt to form a fixing nip through which the recording medium is passed to fix the toner image thereupon under heat and pressure;

a reinforcing member disposed stationary within the roller interior to reinforce the fuser pad; and a heating assembly disposed stationary within the roller interior to heat the metal roller from inside, the heating assembly including:

a first heater having a heating element thereof positioned facing a longitudinal center of the metal roller; and a second heater having a heating element thereof positioned facing two longitudinal ends of the metal roller, the first and second heaters being arranged in juxtaposition with each other along the inner circumference of the metal roller.

* * * * *